United States Patent [19]

Fattori

[11] Patent Number: 4,539,717

[45] Date of Patent: Sep. 10, 1985

[54] SUBMERGIBLE SELF-PRIMING DISPENSER

[75] Inventor: Joseph E. Fattori, Woodcliff Lake, N.J.

[73] Assignee: Waldwick Plastics Corporation, Waldwick, N.J.

[21] Appl. No.: 548,843

[22] Filed: Nov. 4, 1983

[51] Int. Cl.[3] ..... E03D 9/02

[52] U.S. Cl. ..... 4/228

[58] Field of Search ..... 4/227, 228; 422/261, 422/263, 264, 266

[56] References Cited

U.S. PATENT DOCUMENTS

| | | | |
|---|---|---|---|
| 3,908,209 | 9/1975 | Fillmore | 4/227 |
| 4,186,856 | 2/1980 | Dirsking | 4/228 X |
| 4,251,012 | 2/1981 | Owens et al. | 4/227 X |
| 4,307,474 | 12/1981 | Choy | 4/228 |
| 4,429,809 | 2/1984 | Bousgarbies | 4/227 X |

FOREIGN PATENT DOCUMENTS 26284 of 1898 United Kingdom ..... 4/228

*Primary Examiner*—Charles E. Phillips

*Attorney, Agent, or Firm*—Ira J. Hammer

[57] ABSTRACT

This invention provides a submersible self-priming dispenser of measured doses of toilet tank additive in which the additives are solid products which will dissolve in water. It dispenses a measured amount of the water soluble additive each time the tank is emptied. In the present invention, when the tank is full, air locks form to separate both the top and bottom openings of the dispenser from the tank and prevent the water-dissolved additive in the dispenser from mixing with the water in the tank. Dual chambered embodiments are also presented so that, if more than one additive is used, they may be kept in separate solutions between flushes.

4 Claims, 5 Drawing Figures

SUBMERGIBLE SELF-PRIMING DISPENSER

BACKGROUND ART

Passive dosing dispensers for toilets are in evidence in prior patents. For instance, U.S. Pat. No. 3,908,209, which was issued to William E. Fillmore on Sept. 30, 1975, discloses a means for dispensing fluid into a tank as the water recedes by means of a float valve, which allows the dispenser to be open while the water recedes from level A to level B. However, the cost of using a liquid additive is relatively high because of the weight and the subsequent difficulty in handling. Therefore, a more desirable dispenser would allow for the dissolution of a dry tablet additive. U.S. Pat. No. 4,186,856, which was issued to Robert S. Dirksing on Feb. 5, 1980, provides a passive means for dispensing a dry additive in solution. However, the Dirksing invention does not provide complete separation of the additive solution from the tank water.

Most recently, U.S. Pat. No. 4,307,474, which was issued to Clement K. Choy on Dec. 29, 1981, provides a means for separating the additive from the tank water; however, it does not provide for rapid discharge of the solution. The failure to discharge the dispenser rapidly results in the container not completely discharging before the tank starts to refill and, therefore, the dose of additive supplied to the tank is incorrect.

SUMMARY OF THE INVENTION

In accordance with the preferred embodiment of the single dispenser invention, a self priming dispenser is provided which comprises a container with openings at the bottom (inlet/dispensing) and top (air vent), with the inlet/dispensing opening covered on the inside by an inverted cup with openings at the base of its sides. There is an inlet standpipe filling the inlet/dispensing opening and protruding up into the cup. The air vent opening has an air vent standpipe that protrudes into the container. There is a float valve which is a cup within the container that has walls parallel to the outside walls of the container and is made of a material with a specific gravity less than 1.0, so that it will float on water. The additive that is to be dispensed is positioned between the bottom of the float valve and the top of the inverted cup.

When the dispenser is immersed in a tank of water, water enters through the inlet/dispensing opening on the bottom and fills the dispenser as the dispenser is submerged. The water causes the inside cup to rise until the cup seals the top opening. At that point, two air locks are formed. One is at the top of the inside of the container between the air vent standpipe and the outside wall. The other is on the bottom in the inverted cup between its walls and the walls of the inlet standpipe. Those air locks prevent the mixing of the water-dry additive solution inside the container with water outside the container. When the tank is flushed and the outside water level drops below the bottom of the container, water pressure causes the dispenser to discharge its contents totally through the inlet/dispensing opening. As the tank refills, the process repeats until the additive is exhausted. The dual chamber version operates similarly, keeping the additive-water solutions separate from one another and separate from the tank water.

The present invention advances the state of the art by providing for rapid discharge through the use of a float valve, as will be discussed in the Detailed Description of the Drawings. This advance assures that a proper dose will be discharged before the tank starts to refill.

There has been a trend toward smaller toilet tanks which will use less water and be more aesthetically pleasing. The present invention also allows the dispenser to be smaller than those previously manufactured and yet contain the same amount of additive, thus allowing the dispenser to fit in smaller toilet tanks.

Finally, it should be noted that, while the discussion has been geared to toilet tanks that hold water, this invention may be applied to tanks holding other fluids.

BRIEF DESCRIPTION OF THE DRAWINGS

The nature and substance of the present invention as well as its objects and advantages will be more clearly perceived and understood by referring to the following description and claims considered in connection with the accompanying drawings in which:

DETAILED DESCRIPTION OF THE DRAWINGS

Figure 1:
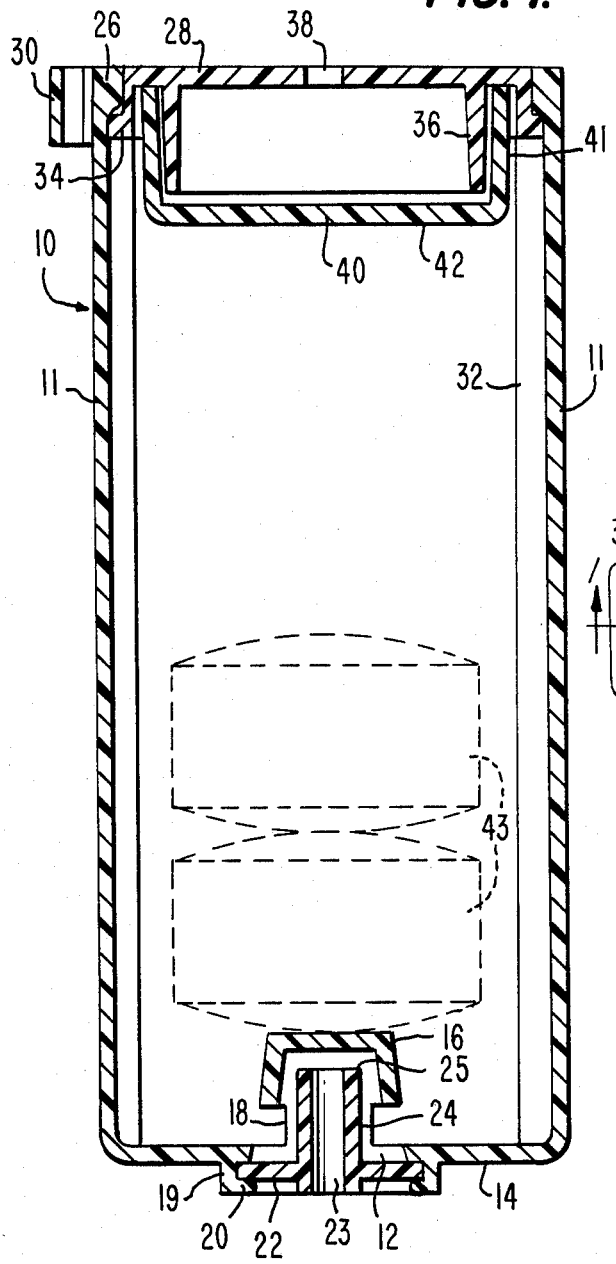
FIG. 1 is a view in sectional elevation of the preferred embodiment of the single chambered dispenser taken along line 1—1 in FIG. 2 looking in the direction of the arrows.
Figure 2:
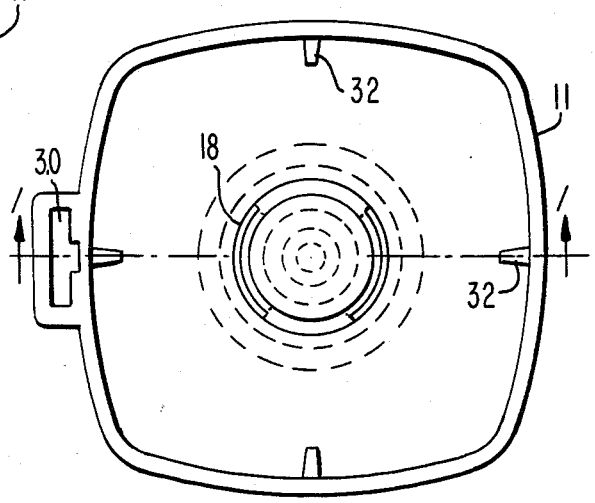
FIG. 2 is a plan view of the top of the preferred embodiment of the single chambered dispenser without the cover, additive and float valve shown.

The single additive dispenser shown in FIGS. 1 and 2, has a container generally designated 10 with four imperforate sides 11, a bottom 14 and an opening 12 in its bottom. There is an internal inverted cup 16 covering that opening, and that cup has at least one cup opening 18 in its side wall. The bottom 14 of the container has an annular ring 19 with undercut groove 20 to hold an inlet cover 22 sealed in position. The inlet cover 22 is chamfered on its outer edge and is characterized by an inlet standpipe 24 with an end surface 25 and an inlet/dispensing opening 23. The cup openings 18 do not rise as high as the end surface 25 of the inlet standpipe. The inlet cover 22 snaps into the annular ring 19 and is retained by the undercut groove 20.

On the inside of the top of the walls 11, there is an undercut bead 26 to hold an access cover 28 sealed in position, and an open loop 30 for receiving the strap or other means that is used to support the container in a tank (not shown). The access cover 28 is supported on ribs 32 formed on the inside of container 10.

The access cover 28 is characterized by a shoulder 34 for retention in the container 10 by the undercut bead 26. The access cover is also characterized by an annular ring 36 that projects into the container 10 and by an air vent opening 38.

Within the container is float valve generally designated 40, a hollow cylinder with walls 41 and a closed bottom 42, which is molded of a material with a specific gravity less than that of the fluid intended for use in the tank. Float valve 40 is maintained centered in container 10 by ribs 32 along which it is free to move vertically. At least one fluid soluble additive cake or tablet 43 is placed in the container between the inverted cup 16 and the float valve 40. When the tank is a toilet tank and the fluid is water, the specific gravity of the float valve material must be less than 1.0.

The single additive dispenser is placed in a toilet tank so that standpipe inlet/dispensing opening 23 is no lower than the lowest level to which the water falls when the toilet tank is flushed. As the tank fills, water rises outside the container until the container 10 is submerged. Water enters the container through inlet standpipe 24. It flows over the end surface 25 of inlet standpipe 24 and down through the cup sidewall openings 18 into the container. As the water rises in the container, air is driven out of the vent opening 38, and float valve 40 rises until it is stopped against the access cover 28. Residual air is trapped between the float valve walls 41, the walls 11 of the container 10, the access cover 28, the undercut bead 26, and annular ring 36, thus forming an air lock and preventing the water inside the container from mixing with the water in the tank. Note that the heights of the float valve wall 41 and the annular ring 36 are not critical. The float valve 40 can be stopped when its wall 41 hits the access cover 28 or when the annular ring 36 hits the inside of the float valve 40. Also, air trapped under the inverted cup 16 that covers the inlet standpipe 24 forms an air lock that prevents water inside the container from mixing with the water in the tank. Additive 43 commences a slow dissolution forming a solution with the water within container 10.

When the toilet tank is flushed, the water outside the container drops and the change in pressure causes the container to empty its contents through the the inlet/-dispensing opening 23 in inlet standpipe 24. When the float valve 40 falls so that the top of its wall is below the bottom of the annular ring 36, air enters more quickly and the container rapidly discharges its content. This rapid discharge helps assure that the contents of the container are discharged before the tank starts refilling. As the tank refills, water again fills the container, the air locks reform, and the process repeats itself. When the supply of additive is exhausted, the dispenser may be refilled by unsnapping the access cover 28.

Figure 5:
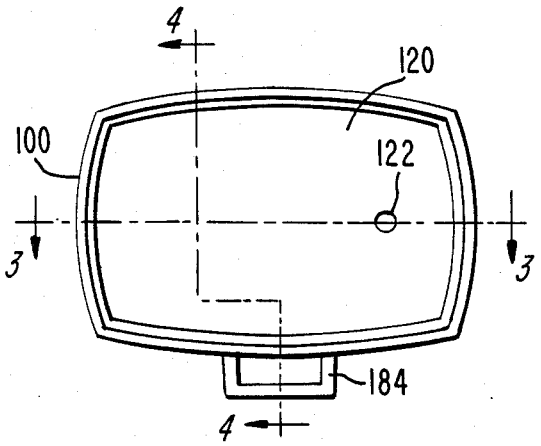
FIG. 5 is a top view of the preferred embodiment of the dual chambered dispenser with the cover on it.
Figure 3:
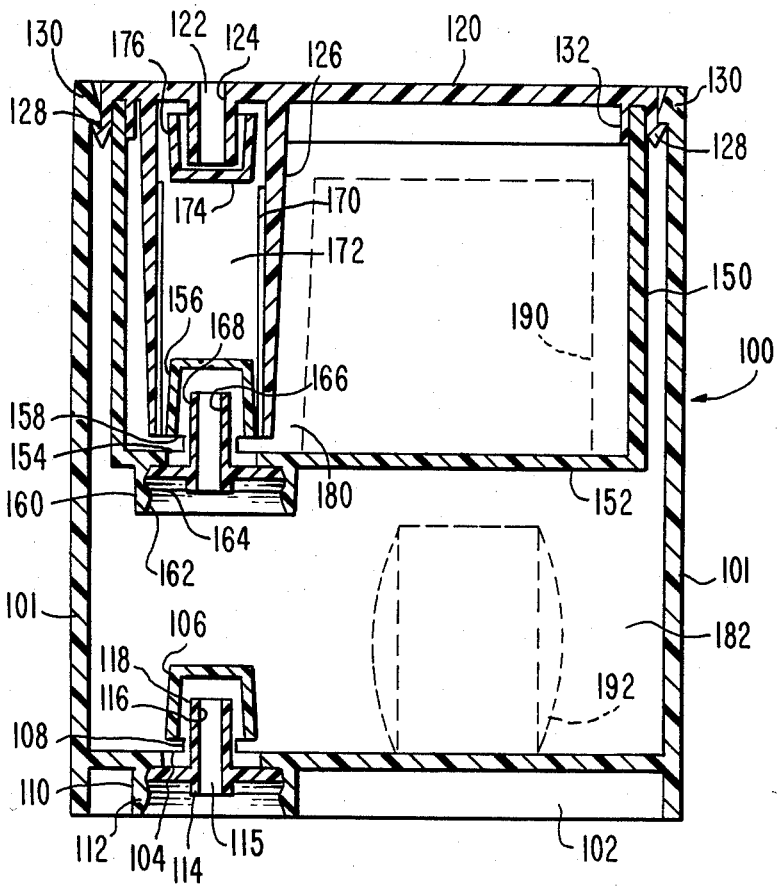
FIG. 3 is a sectional elevation of the preferred embodiment of the dual chambered dispenser taken along line 3—3 in FIG. 5 looking in the direction of the arrows.
Figure 4:
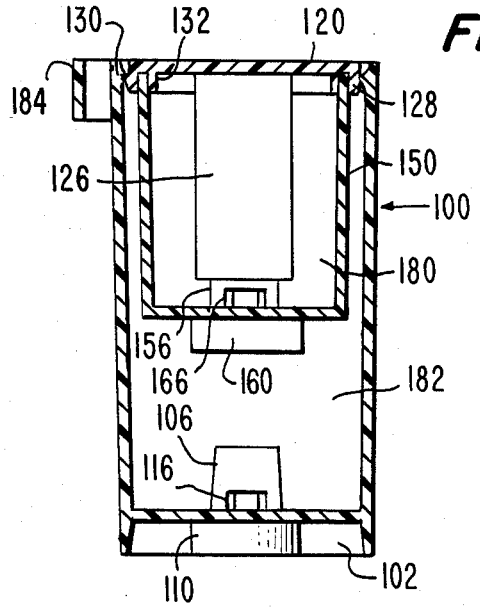
FIG. 4 is a sectional elevation of the preferred embodiment of the dual chambered dispenser taken along line 4—4 in FIG. 5 looking in the direction of the arrows.

Referring next to FIGS. 3, 4 and 5, the dual chamber dispenser shown therein has an outer container generally designated 100 with four imperforate sides 101 and a bottom 102 with a bottom opening 104 in it. The bottom opening 104 has an inverted cup 106 over it on the inside, with at least one opening 108 in its side wall. Circumscribing the bottom opening 104 on the outside is an annular ring 110 with an undercut bead 112 to hold an inlet cover 114 sealed in position. The inlet cover is characterized by an inlet standpipe 116 with an inlet/-dispensing opening 115 through it and an end surface 118 that protrudes into the inverted cup 106 above its side wall openings 108. On the inside of the walls 101 at the top, there is an undercut bead 130 to hold an access cover 120 sealed in position. The access cover 120 has an outside and an inside. It is characterized by an air vent opening 122 on the outside, and on the inside by an air vent standpipe 124, measuring walls 126 possibly although not necessarily cylindrical, a shoulder 128 to hold it sealed in the outer container by snapping into undercut bead 130, and an annular ring 132 to hold an inner container generally designated 150 sealed in position. The space between the inner container 150 and the outer container 100 is a chamber 182.

The inner container 150 has an inner bottom 152 and four imperforate walls that attach to the underside of the access cover 120 of the outer container by snapping into the annular ring 132 on the inside of the access cover 120. The inner bottom is characterized by an inner bottom opening 154 with an inner inverted cup 156 over it. The inner inverted cup 156 is characterized by openings 158 near the base of its side walls. Circumscribing the inner bottom opening 154 on the outside is an outer annular ring 160 with an undercut bead 162 to hold an inner inlet cover 164 sealed in position. The inner inlet cover 164 is characterized by an inner inlet standpipe 166 with a lip 168. The inner inlet standpipe 166 protrudes into the inverted cup 156 and rises above its sidewall openings 158.

The measuring walls 126 surrounding the air vent standpipe 124 are characterized by ribs 170 and define a chamber 172 for a float valve 174. The space between the measuring walls and the inner container walls is a chamber 180. The float valve 174 is cup shaped with sides 176 parallel to the measuring walls 126 and is kept properly aligned by the ribs 170. The float valve is made of material with a specific gravity less than the fluid intended for use in the tank. The chamber 172 is open on the bottom; however, the combined length of the measuring walls and the float valve sides 176 keeps the float valve in the chamber. There are additives 190 and 192 in chambers 180 and 182 respectively. Additives 190 and 192 could be the same but generally will be different. A loop 184 shown particularly in FIGS. 4 and 5 is formed on container 100 for engagement with a means for supporting the dispenser in the tank.

The dual additive dispenser is placed in a toilet tank so that the inlet/dispensing opening 115 is no lower than the lowest level to which the water falls when the toilet tank is flushed. As the toiler tank fills, water rises outside the container until the outer container 100 is submerged. Water enters the container through inlet/-dispensing opening 115 in inlet standpipe 116. It flows over the end surface 118 of inlet standpipe 116 and down through the cup side wall openings 108 into the outer container. As the water rises, air is driven out through inlet standpipe 166 and air vent standpipe 122, and water fills the outer container to the level of the inner inlet standpipe 166. Residual air trapped in the outer container prevents it from further filling, and the water flows through the inner inlet standpipe 166, over end surface 168, through openings 158 and into the inner container driving more air out through air vent standpipe 122. Water fills the inner container only to the level of the measuring walls 126 and then fills chamber 172. As the water rises in the chamber, float valve 174 rises until it is stopped against the access cover 120. Air is trapped between the access cover 120, the float valve walls 176, the measuring walls 126 and the air vent standpipe 124, thus forming an air lock and preventing the water inside the container from mixing with the water in the tank. Note that the heights of the float valve walls 176 and the air vent standpipe 124 are not critical. The float valve 174 can be stopped when its walls 176 hit the access cover 120 or when the air vent standpipe 124 hits the inside of the float valve 174. Also, air trapped under the inverted cup 106 that covers the inlet standpipe 116 and the inner inverted cup 156 that covers the inner inlet standpipe 166 forms air locks that prevent water inside the container from mixing with the water in the tank and from mixing with the water inside the inner container 150 from mixing with water in the outer container 100. Additives 190 and 192 inside the containers form separate solutions with the water.

When the tank is flushed, the water outside the container drops and the change in pressure causes the inner container to empty its contents through the inner inlet standpipe 166, and both containers to empty their contents through the inlet/dispensing opening 115. When the float valve 174 falls so that the top of its walls 176 is below the bottom of the air vent standpipe 124, air will enter more quickly and the container will rapidly discharge its content. This rapid discharge helps assure that the containers are discharged before the tank starts refilling. As the tank refills, water again fills the container; the air locks reform, and the process repeats itself. When the additives are exhausted, the dispenser may be refilled by unsnapping the outer container 100 and inner container 150 from the access cover 120.

CONCLUSION

Protection by Letters Patent of this invention in all its aspects as the same are set forth in the appended claims is sought to the broadest extent that the prior art allows.

I claim as my invention:

1. A submergible self-priming dispenser disposed to be located within a fluid containing vessel comprising:

(a) a means for containing a fluid, (i) said means having a top, a bottom and an opening in its bottom, said bottom opening having an inlet standpipe protruding up from the opening into the inside of the containing means, said inlet standpipe having an inlet/dispensing opening through it and being surrounded by an inverted cup, said inverted cup having at least one cup wall that circumscribes the bottom opening and inlet standpipe, said wall having at least one opening at its base that is lower in height than the inlet standpipe; and (ii) said means having an air vent opening on its top, said air vent opening having an air vent standpipe protruding down into the containing means;

(b) a float valve means, said means being a cup, said cup having at least one cup wall that defines a larger diameter than the air vent standpipe and a smaller diameter than the walls of the containing means, said cup being placed within the containing means so that it can float between the bottom and top of the containing means.

2. A submergible self-priming dispenser disposed to be located within a fluid containing vessel comprising:

(a) a means for containing a fluid, (i) said means having a bottom, at least one side, a bottom opening in its bottom, an inverted cup, said inverted cup having at least one cup wall that circumscribes the bottom opening, said wall having at least one opening at its base, a means for sealingly retaining an access cover at the top of its side, and a means for sealingly retaining an inlet cover to cover the bottom opening; and (ii) said means having an access cover characterized by an air vent opening and an air vent standpipe that protrudes down into the containing means from the access cover, and wherein said cover is sealingly retained in the containing means by the means for sealingly retaining an access cover held in position; and (iii) said means having an inlet cover characterized by an inlet standpipe, and wherein said inlet cover is sealingly retained by the means for sealingly retaining an inlet cover, said inlet standpipe protruding up from the inlet cover into the inside of the containing means, said inlet standpipe having an inlet/dispensing opening through it, said inlet standpipe protruding into the inverted cup above the height of the cup wall opening; and (b) a float valve means, said means being a cup, said cup having at least one cup wall that defines a larger diameter than the air vent standpipe and a smaller diameter than the walls of the containing means, said cup being placed within the containing means so that it can float between the bottom of the containing means and the access cover.

3. The dispenser of claim 2, wherein the means for sealingly retaining an access cover comprises a first annular ring with undercut bead on the inside of the top of the side of the containing means, a second annular ring on the inside of the top of the side of the containing means below the first ring, and a shoulder on said access cover to sealingly snap into the first annular ring.

4. A submergible self-priming dispenser disposed to be located within a fluid containing vessel comprising:

(a) a means for containing a fluid, (i) said means having a top, at least one side, a bottom and an opening in its bottom, said opening having an inlet standpipe protruding up from the opening into the inside of the containing means, said inlet standpipe having an inlet/dispensing opening through it and being surrounded by an inverted cup, said inverted cup having at least one cup wall that circumscribes the bottom opening and inlet standpipe, said wall having at least one opening at its base that is lower in height than the inlet standpipe; and wherein the surface area of a cross-section of the inlet/dispensing opening is less than the surface area of the opening formed between the outside of the inlet standpipe and the inside of the inverted cup; and wherein the surface area of a cross-section of the inlet/dispensing opening is less than the surface area of the openings in the wall of the inverted cup;

(ii) said means having an air vent opening on its top, said air vent opening having an air vent standpipe protruding down into the containing means; and (b) a float valve means, said means being a cup, said cup having a cup wall that defines a larger diameter than the air vent standpipe and a smaller diameter than the walls of the containing means said cup being placed within the containing means, so that it can float between the bottom and top of the containing means.

* * * * *